US005893773A

United States Patent [19]

Dellinger

[11] Patent Number: 5,893,773

[45] Date of Patent: Apr. 13, 1999

[54] ELECTRICAL CONNECTOR HAVING A COVER WITH PRE-STAGE POSITIONING

[75] Inventor: Donald Eugene Dellinger, Hellam, Pa.

[73] Assignee: The Whitaker Corporation, Wilmington, Del.

[21] Appl. No.: 08/866,481

[22] Filed: May 30, 1997

[51] Int. Cl.[6] ..... H01R 4/26

[52] U.S. Cl. ..... 439/404

[58] Field of Search ..... 439/404, 357, 439/358, 405, 417, 435, 456, 459, 470, 701

[56] References Cited

U.S. PATENT DOCUMENTS 5,762,513 6/1998 Stine ..... 439/404

*Primary Examiner*—Steven L. Stephan
*Assistant Examiner*—Eugene G. Byrd
*Attorney, Agent, or Firm*—Robert Kapalka

[57] ABSTRACT

An electrical connector for terminating flat cable comprises a housing which holds a plurality of contacts, and a cover which is attachable to the housing. The cover is relatively movable on the housing from an initial position wherein the flat cable can be inserted between the cover and the housing, to a final position wherein the flat cable becomes terminated to the connector. The cover has latch arms receivable in wells in the housing, and the housing has protuberances which extend into the wells from side walls thereof. The protuberances serve as stops which are abutted by the latch arms when the cover is in the initial position, thereby temporarily preventing movement of the cover beyond the initial position.

3 Claims, 6 Drawing Sheets

ELECTRICAL CONNECTOR HAVING A COVER WITH PRE-STAGE POSITIONING

FIELD OF THE INVENTION

The invention relates to an electrical connector having a cover which can be pre-assembled in an initial position before being driven to a final assembly position.

BACKGROUND OF THE INVENTION

An electrical connector for flat ribbon cable which is sold under the trademark AMP-LATCH by AMP Incorporated of Harrisburg, Pa. comprises a housing which holds a plurality of contacts, and a cover which can be pre-assembled to the housing in an initial position and later driven to a final position to terminate the cable. When the cover is in the initial position the ribbon cable can be inserted between the housing and the cover so that the connector can be located along the cable. For such a connector there is a need to prevent the cover from being accidentally driven beyond the initial position prior to planned final termination so that the cover remains spaced from the housing to receive the ribbon cable therebetween. The cover has latch arms which engage locking tabs on the housing to hold the cover in the final position. The latch arms have bumps which engage surfaces on the cover to provide a means for preventing accidental movement of the cover beyond the initial position. The bumps are sheared off upon application of a sufficient force to drive the cover to the final position. A problem with providing these bumps on the cover is that complex molding equipment is required, including the use of "cam-action" or "multi-draw" molds. Consequently, mold cost, maintenance and cycle time are quite high. There is a need for an electrical connector having a mechanical feature which can hold a cover in an initial pre-stage position and which can be molded with simple equipment.

SUMMARY OF THE INVENTION

The invention is an electrical connector for terminating flat cable comprising a housing which holds a plurality of contacts, and a cover which is attachable to the housing. The cover is relatively movable on the housing from an initial position wherein the flat cable can be inserted between the cover and the housing, to a final position wherein the flat cable becomes terminated to the connector. The cover has latch arms receivable in wells in the housing. According to the invention, the housing has protuberances which extend into the wells from side walls thereof. The protuberances serve as stops which are abutted by the latch arms when the cover is in the initial position, thereby temporarily preventing movement of the cover beyond the initial position.

According to one aspect of the invention, the wells are disposed at longitudinal ends of the housing, and a pair of the protuberances are laterally opposed to each other in each of the wells.

According to another aspect of the invention, each of the latch arms has a shearing surface configured to shear one of the protuberances from one of the side walls when the cover is moved beyond the initial position.

BRIEF DESCRIPTION OF THE DRAWINGS

The invention will now be described by way of example with reference to the accompanying drawings wherein.

DETAILED DESCRIPTION OF AN EMBODIMENT OF THE INVENTION

Figure 1:
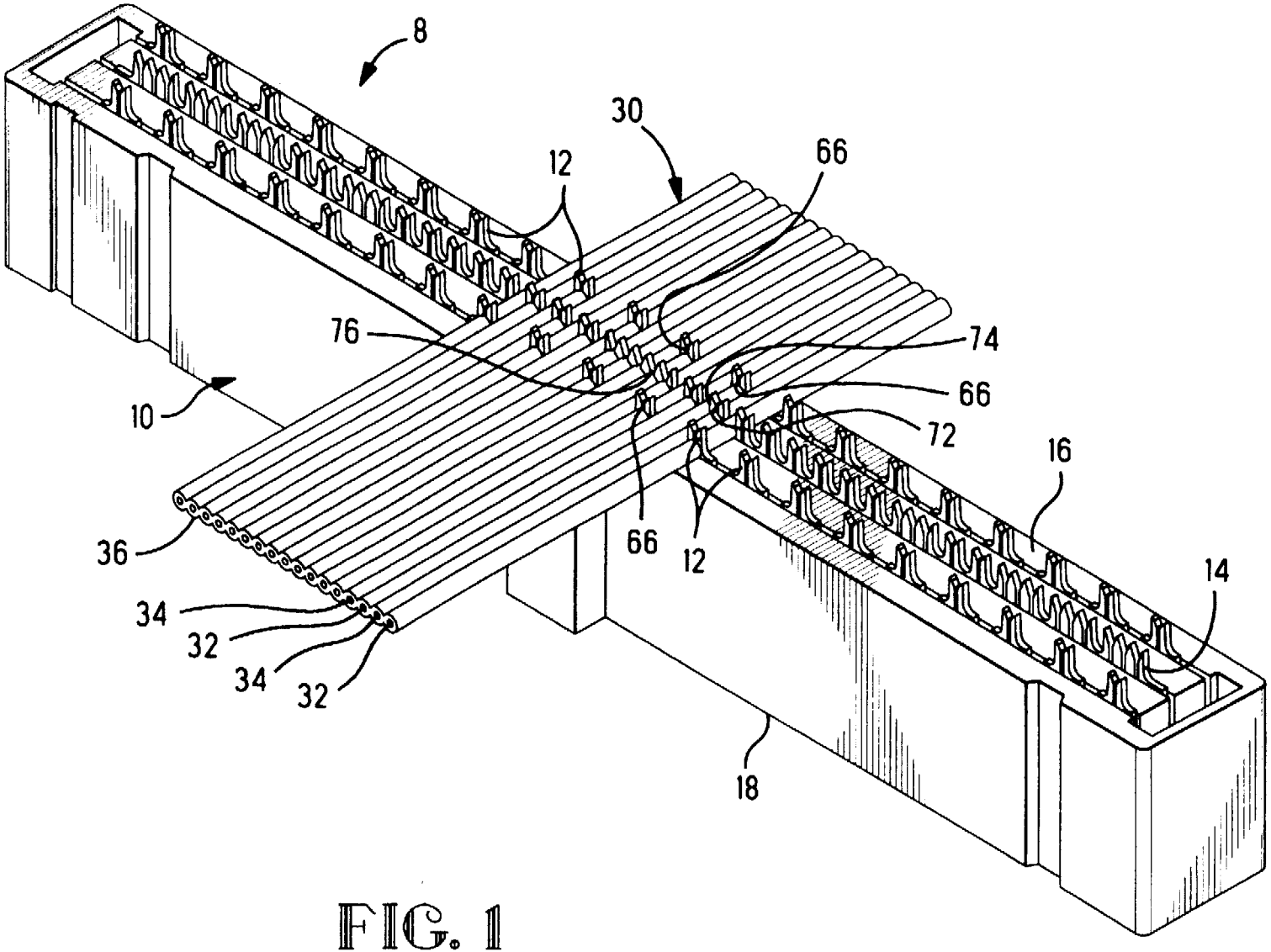
FIG. 1 is an isometric view of an electrical connector according to the invention terminated to a ribbon cable.

There is shown in FIG. 1 an electrical connector 8 comprising an insulative housing 10 which holds a plurality of signal contacts 12 in two longitudinal rows on opposite sides of a ground bus 14. The housing has a terminating face 16 and an opposite mating face 18. The connector 8 is adapted for terminating a flat ribbon cable 30 of the type having a plurality of signal conductors 32 and ground conductors 34 arranged in an alternating sequence in side-by-side parallel alignment within an insulative jacket 36. The cable 30 typically has a sufficient number of signal and ground conductors 32, 34 to extend across the length of the connector 8, although only a portion of the signal and ground conductors of the cable 30 are shown in FIG. 1. The cable 30 is applied to the connector so that the cable extends laterally across the terminating face 16 of the housing 10.

With further reference to FIGS. 2–5, the signal contacts 12 are installed in respective cavities 20 which are open to the terminating face 16 of the housing 10, and the ground bus 14 is installed in a ground bus slot 22 which is also open to the terminating face 16. The cavities 20 for the signal contacts typically extend through the housing so that they are also open to the mating face 18 of the housing. Each of the signal contacts 12 has a retention section 62 that is interference fitted in one of the cavities 20 to retain the signal contact in the cavity. Each of the signal contacts 12 has a termination section 60 which extends above the terminating face 16 of the housing and includes a signal conductor termination slot 66. The slot 66 is bounded by opposed edges which are configured for insulation displacement termination of a respective signal conductor 32 that is inserted into the slot. Each of the signal contacts has a mating section which includes opposed beams 68 that mate with a pin of a mating connector (not shown) when the pin is inserted into the cavity 20 through the mating face 18.

Figure 6:
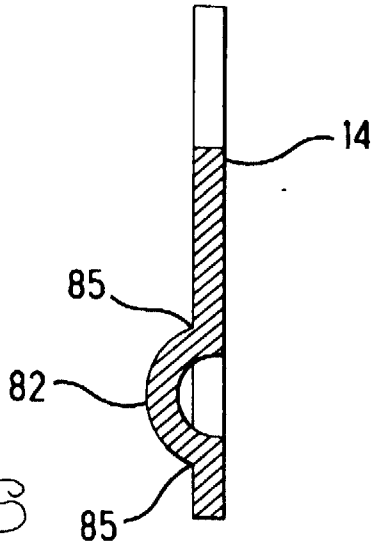
FIG. 6 is a cross-sectional view through a ground bus for the connector taken along line 6—6 of FIG. 3.
Figure 4:
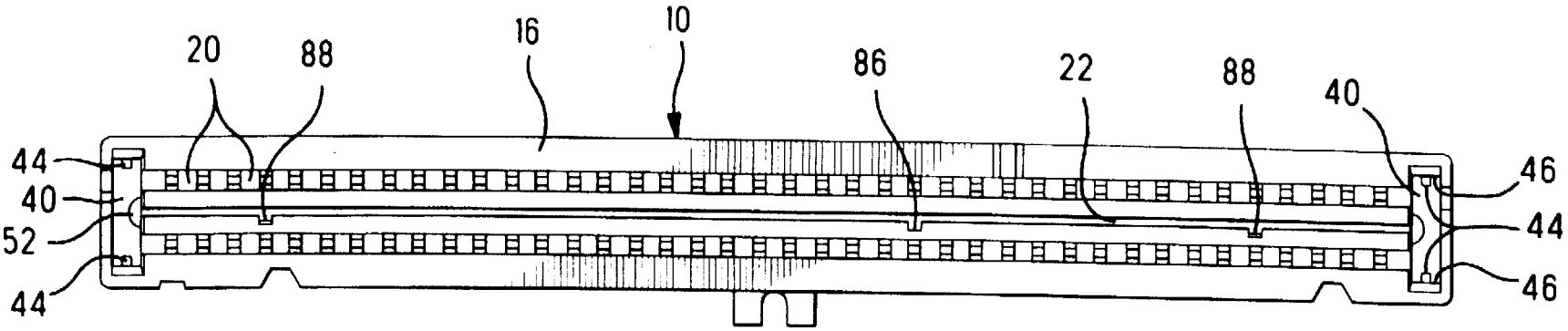
FIG. 4 is a top view of a housing for the connector.
Figure 5:
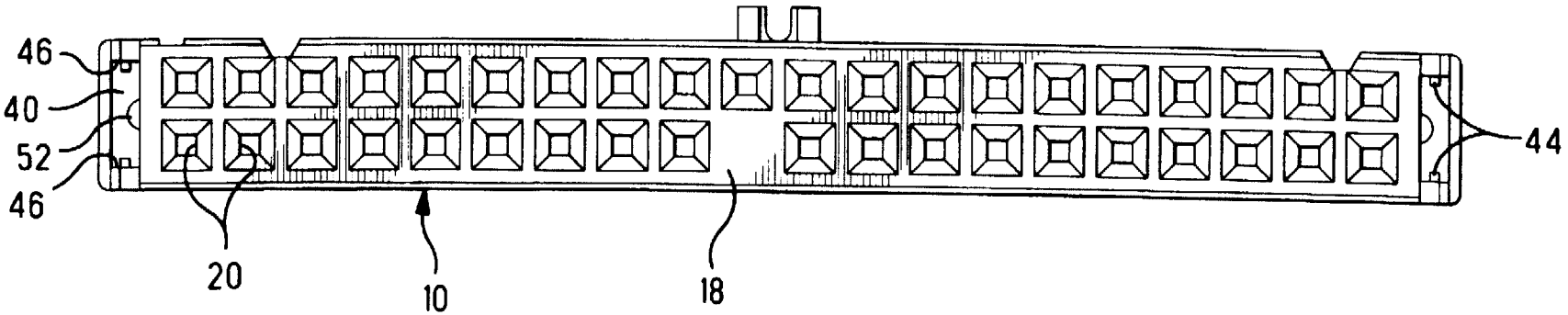
FIG. 5 is a bottom view of the connector housing.
Figure 7:
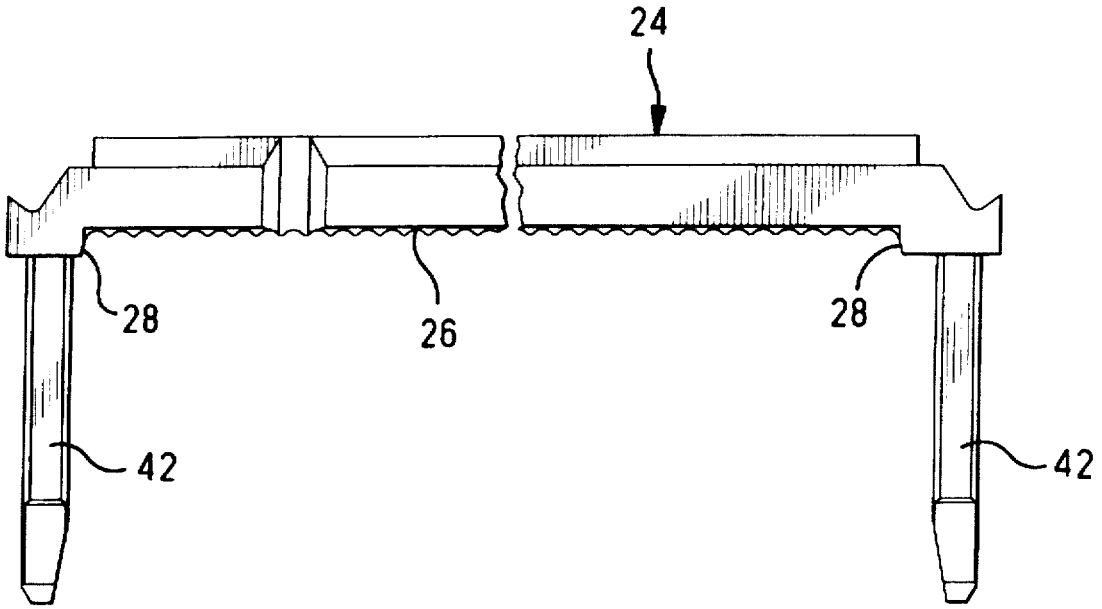
FIG. 7 is a front view of the connector cover.
Figure 8:
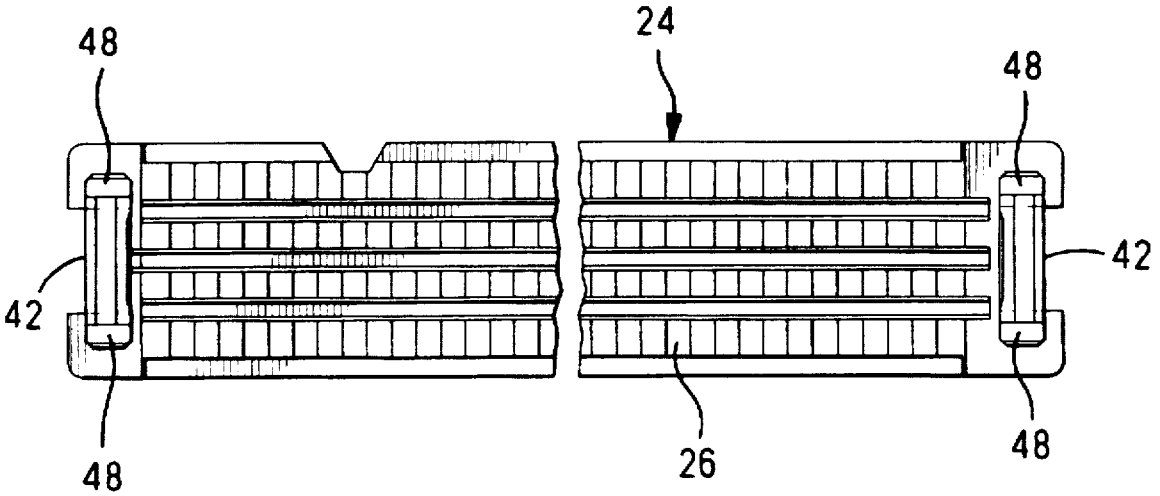
FIG. 8 is a bottom view of the connector cover.
Figure 9:
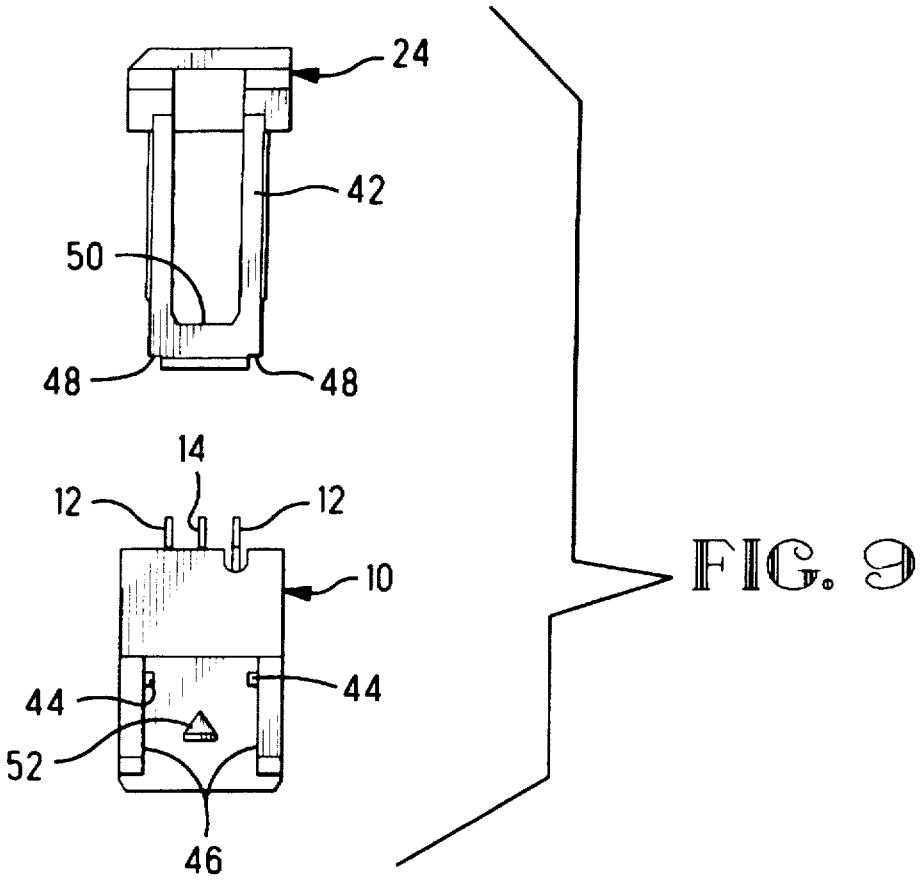
FIG. 9 is side view of the connector with the cover disposed for installation on the connector.

The ground bus 14 is stamped and formed from sheet material and is essentially planar except for three projections including a middle projection 82 and end projections 84 which are deformed out of a plane of the ground bus. As shown in FIG. 6, each of the projections 82, 84 is formed integrally in the ground bus into an arcuate-shaped strip having ends 85 that are attached to the ground bus. The projections 82, 84 are received in corresponding middle recess 86 and end recesses 88 in a side wall of the ground bus slot 22 as shown in FIG. 4. The projections 82, 84 cooperate with the recesses 86, 88 to retain the ground bus in the housing. Further, the middle projection 82 cooperates with the middle recess 86 to serve a keying function as will be explained hereinbelow.

Figure 2:
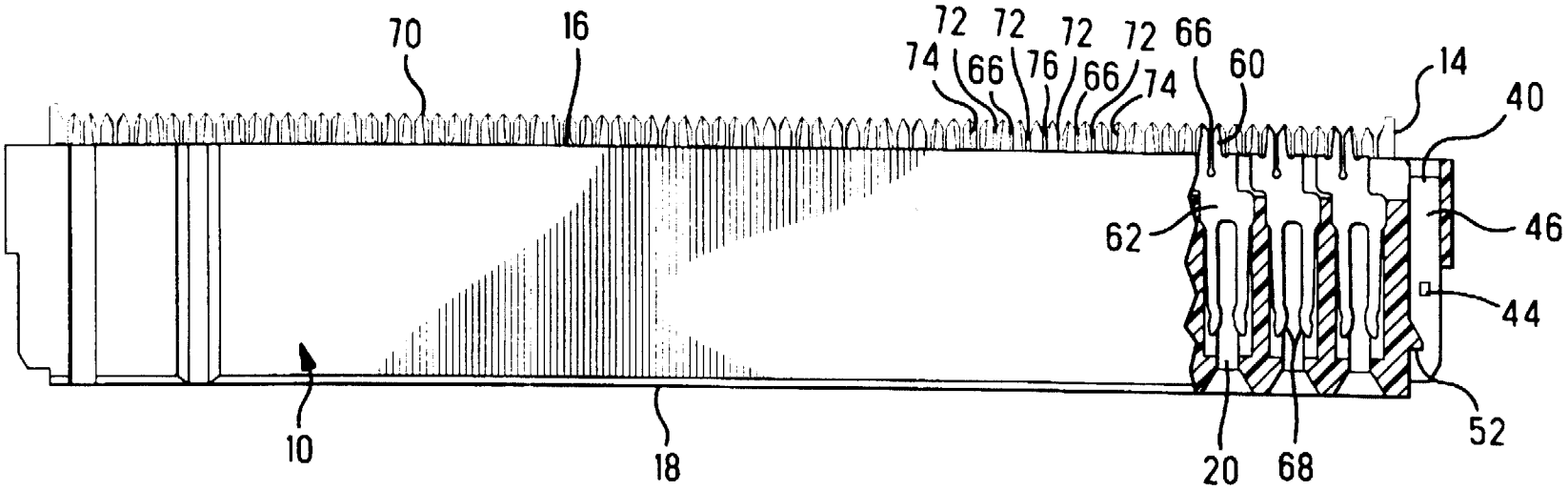
FIG. 2 is a front view of the connector with one end of the connector shown in cross-section.
Figure 3:
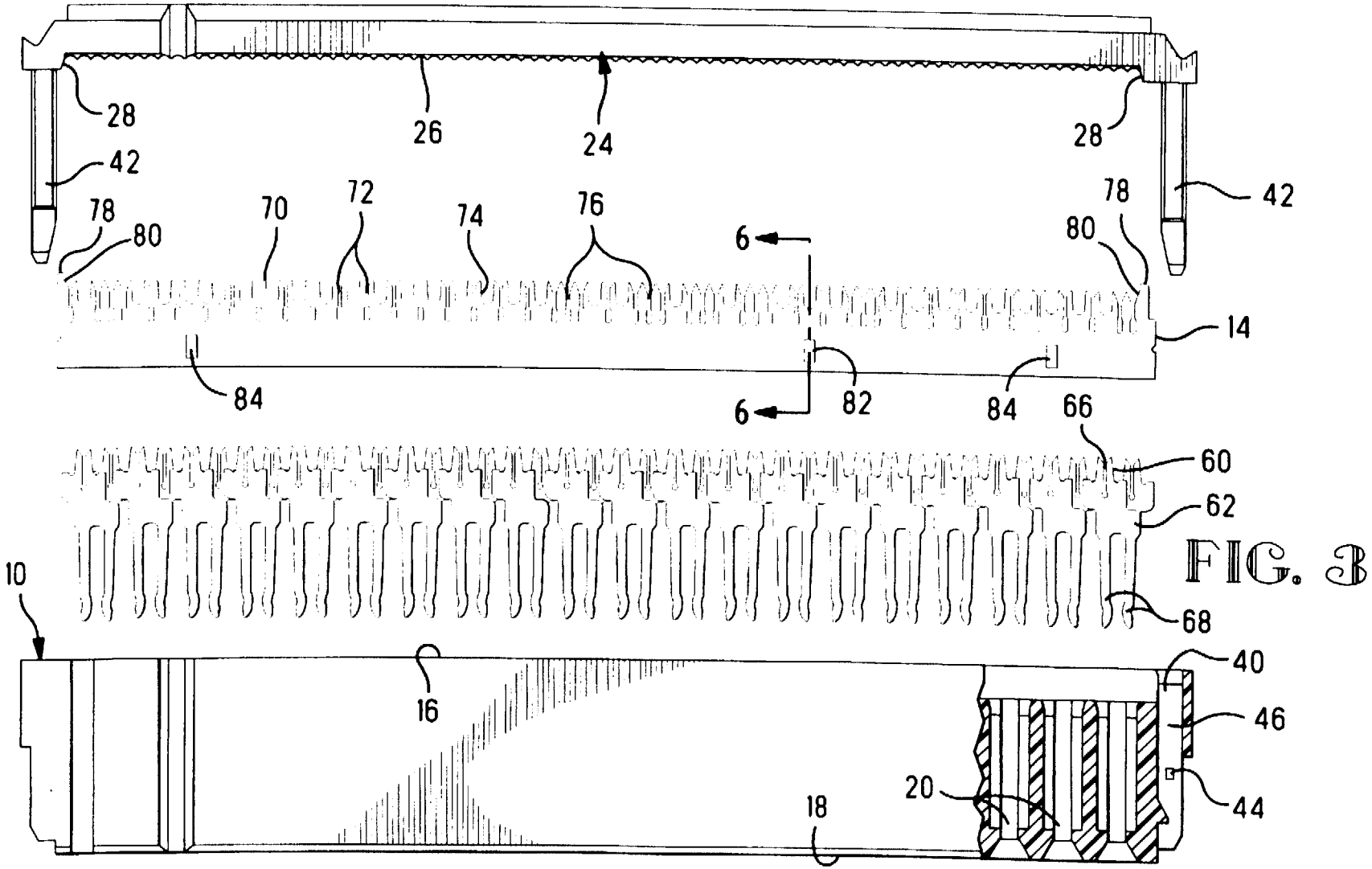
FIG. 3 is an exploded view of the connector shown in FIG. 2, and also showing a cover for the connector.

Referring to FIGS. 1–3, the ground bus 14 has an edge portion 70 which is formed as a termination section that extends above the terminating face 16 of the housing. The edge portion 70 is formed with a plurality of ground conductor termination slots 72 that are configured for insulation displacement termination of respective ones of the ground conductors 34. The edge portion 70 of the ground bus also has bypass slots 74 which are configured larger than the signal conductors 32. Each of the bypass slots 74 is laterally aligned with one of the signal conductor termination slots 66 of an associated signal contact 12. When the cable 30 is terminated to the connector 8 as shown in FIG. 1, the bypass slots 74 receive and accommodate the signal conductors 32 that are terminated in the associated signal contacts 12, thereby allowing the signal conductors to enter the edge portion 70 of the ground bus so as to extend through the ground bus without being terminated to the ground bus. Provision of the bypass slots 74 permits the signal conductor termination slots 66 in the signal contacts and the ground conductor termination slots 72 in the ground bus to be arranged such that the signal and ground conductors 32, 34 of the ribbon cable will all reside in a common plane adjacent to the terminating face 16 of the connector after termination thereto.

The edge portion 70 of the ground bus may also have signal conductor termination slots 76 which are configured for insulation displacement termination of selected ones of the signal conductors 32. Each of the signal conductor termination slots 76 may be provided in place of a corresponding bypass slot 74, thereby providing for selective termination of one of the signal conductors 32 to the ground bus 14. The signal conductor termination slots 76 may be selectively arranged on the ground bus. That is, the ground bus may be produced in different configurations each programmed to common different selected ones of the signal conductors 32 to the ground bus.

The different configurations of the ground bus can be installed in connector housings to provide flat cable electrical connectors which differ only by the programmed selection of the signal conductors to be grounded. In order to differentiate between programmed electrical connectors, the connector housings are color coded. However, there is still a need to prevent inadvertent installation of a ground bus programmed with one configuration into a connector housing that is color-coded for a different configuration. Therefore, the ground bus and the housing have cooperative keying features for each configuration. In particular, the middle projection 82 of the ground bus is located at a different position along the ground bus for each different programmed configuration of the ground bus, and the corresponding color-coded housing has a middle recess 86 in alignment with the projection.

Towers 78 at both ends of the ground bus have surfaces 79 that serve to align the cable 30 in the connector during termination.

With reference to FIGS. 3, 4 and 7–11, the connector 8 receives a cover 24 that is driven toward the housing 10 with the cable 30 therebetween to terminate the cable to the connector 8. The cover 24 has a scalloped surface 26 which accommodates the individual signal and ground conductors 32, 34 of the ribbon cable, thereby providing a nest for the cable. Side surfaces 28 of the nest are contoured to flank the cable closely, thereby helping to align the cable in the nest and in the connector.

Figure 10:
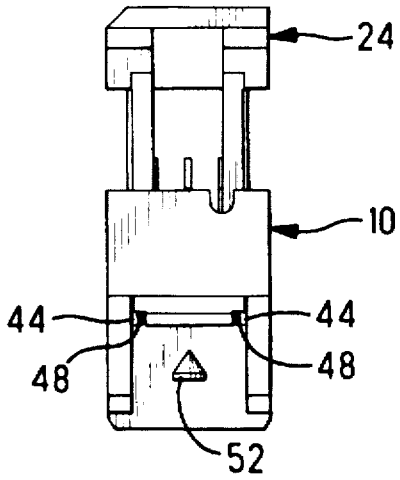
FIG. 10 is a side view of the connector with the cover installed in a pre-stage position.
Figure 11:
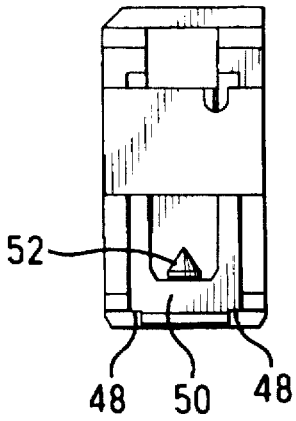
FIG. 11 is a side view of the connector with the cover installed in a fully assembled position.

Each longitudinal end of the housing 10 has a well 40 which receives a latch arm 42 of the cover 24. The housing has bumps or protuberances 44 which extend into each well 40 from side walls 46 thereof. A pair of the protuberances 44 are laterally opposed to each other within each well. The protuberances 44 act as stops which are abutted by shearing surfaces 48 of the latch arms 42 as the latch arms are inserted into the wells, thereby locating the cover at an initial, pre-stage position on the housing as shown in FIG. 10. The latch arms 42 have a slight interference fit between the side walls 46 of the wells, thereby providing a sufficient drag on the latch arms to keep the cover in the pre-stage position. In this position the cable 30 can be threaded between the cover 24 and the housing 10. Upon application of a force that drives the cover and the housing together, the protuberances 44 are sheared from the walls 46 of the well by the surfaces 48 on the latch arms 42. The cover is retained in a final, assembled position on the housing by latch bars 50 on the latch arms 42 which become locked beneath locking tabs 52 on the housing, as shown in FIG. 11.

The invention provides an electrical connector including a housing having wells and protuberances which extend into the wells to provide pre-stage positioning for a cover. The housing can be molded with single draw molding equipment, thereby reducing manufacturing time and expense.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical connector for terminating flat cable comprising:

a housing which holds a plurality of contacts;

a cover attachable to the housing, the cover being relatively movable on the housing from an initial position wherein the flat cable can be inserted between the cover and the housing, to a final position wherein the flat cable becomes terminated to the connector, the cover having latch arms receivable in wells in the housing; and the housing having protuberances which extend into the wells from side walls thereof, the protuberances serving as stops which are abutted by the latch arms when the cover is in the initial position, thereby temporarily preventing movement of the cover beyond the initial position, the latch arms having shearing surfaces which operate to shear the protuberances from the side walls when the cover is driven beyond the initial position, and the housing having locking tabs which cooperate with the latch arms to retain the cover in the final position.

2. The electrical connector according to claim 1, wherein a pair of the protuberances are opposed to each other in each of the wells.

3. The electrical connector according to claim 1, wherein the wells are disposed at longitudinal ends of the housing, and a pair of the protuberances are laterally opposed to each other in each of the wells.

* * * * *